United States Patent [19]

Chiasson

[11] 4,403,455

[45] Sep. 13, 1983

[54] BELT GRINDER FOR SHARPENING ICE SKATE BLADES AND THE LIKE

[76] Inventor: Robert H. Chiasson, 1 Linden St., Maynard, Mass. 01754

[21] Appl. No.: 252,923

[22] Filed: Apr. 10, 1981

[51] Int. Cl.[3] ..... B24B 21/10

[52] U.S. Cl. ..... 51/141; 51/228

[58] Field of Search ..... 51/135 R, 137, 141, 51/228; 76/83

[56] References Cited

U.S. PATENT DOCUMENTS

| | | | |
|---|---|---|---|
| 1,633,552 | 6/1927 | Wells | 51/137 |
| 3,092,936 | 6/1963 | Marsh | 51/141 |
| 3,650,073 | 3/1972 | Weisman | 51/141 |
| 4,078,337 | 3/1978 | Chiasson | 51/141 |

FOREIGN PATENT DOCUMENTS

| | | | |
|---|---|---|---|
| 1259428 | 3/1961 | France | 51/135 R |

*Primary Examiner*—Harold D. Whitehead
*Assistant Examiner*—K. Bradford Adolphson
*Attorney, Agent, or Firm*—Morse, Altman & Dacey

[57] ABSTRACT

A belt grinding apparatus is provided for obtaining maximum wear from an abrasive belt. The apparatus is particularly useful in sharpening skate blades and the like and involves a motor-driven belt arrangement in which the belt is passed over an idler pulley for guidance diagonally across the working edge of a relatively fixed platen whereby a diagonal section of the running belt substantially wider than the width of the belt is presented for grinding action against a workpiece.

A movable carriage clamp is provided to hold the skate blade in grinding position and move it in a straight line against the diagonally moving belt. The platen is mounted for adjustment to accommodate skate blades of different thicknesses.

6 Claims, 7 Drawing Figures

BELT GRINDER FOR SHARPENING ICE SKATE BLADES AND THE LIKE

BACKGROUND OF THE INVENTION

1. Field of the Invention

This invention relates generally to belt grinding machines and more particularly is directed towards a new and improved apparatus for sharpening the blade edges of ice skates.

2. Description of the Prior Art

The conventional technique for sharpening ice skates is to use a standard grinding wheel and to move the blade edge across the face of the wheel. The skate is usually held with the blade in the same plane as the wheel so that the blade edge is tangential to the wheel. Using the wheel with a cylindrical peripheral surface, the blade will be ground flat. If it is desired to hollow grind the blade, as is commonly the case, it is necessary to first shape the periphery of the wheel to the desired radius using an appropriate tool. Insofar as different types of skates require different curvatures, a considerable amount of time is involved in changing from one radius of curvature to another and a good deal of the wheel is wasted in the process. Further, conventional skate sharpening equipment tends to produce non-uniform results and different operators using the same equipment often produce different results.

In U.S. Pat. No. 4,078,337 there is disclosed a belt grinding machine for sharpening ice skates wherein a relatively narrow abrasive endless belt is moved along one of several curved working faces of a platen while a skate blade is moved lengthwise with respect to the platen and belt. While the foregoing apparatus produces a very good edge to the blade it has been found that the belt tends to wear rather rapidly, particularly along the center line thereof where most of the grinding action takes place. This required frequent changing of the belts and some wastage of materials.

It is an object of the present invention to provide improvements in belt grinding machines.

Another object of this invention is to provide an improved skate sharpening apparatus characterized by substantially complete utilization of abrasive belts and reduced wear thereon.

A further object of this invention is to provide a skate sharpening apparatus adapted to produce a high quality cutting edge on the blades of ice skates by relatively unskilled operators.

Still a further object of this invention is to provide a skate sharpening apparatus having a platen which is movable to change the center of curvature on a blade being sharpened as well as being provided with a platen formed with different curvatures which may be indexed easily into working position.

SUMMARY OF THE INVENTION

This invention features a belt grinding apparatus for use in sharpening the edges of ice skate blades or the like, comprising an elongated platen, at least a pair of spaced pulleys at least one of which is driven and rotatably mounted about parallel axes which are disposed at a tilt with respect to the length of the platen and an endless abrasive belt roven about the pulleys and diagonally across the working face of the platen whereby a workpiece, such as a blade, moved along a path parallel to the platen and against that portion of the belt moving over the platen will be ground to a contour corresponding to the contour of the platen and will engage a diagonal section of the belt which diagonal section exceeds the width of the belt so that the entire working surface of the belt will be utilized.

DETAILED DESCRIPTION OF THE PREFERRED EMBODIMENTS

Figure 1:
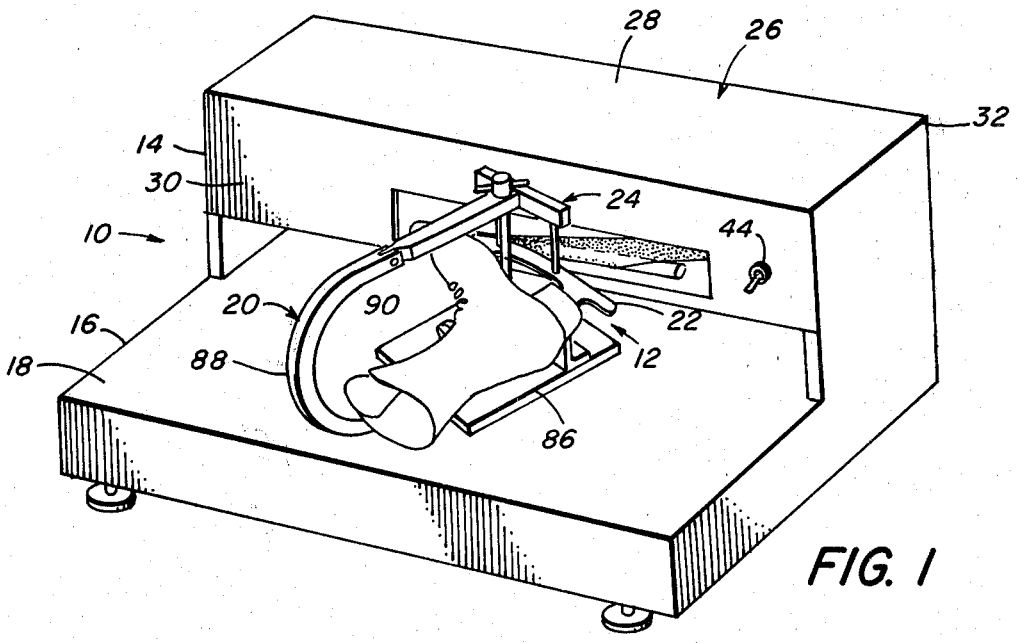
FIG. 1 is a view in perspective of the invention embodied in a skate sharpening apparatus.

Referring now to the drawings, the reference character 10 generally indicates an apparatus for grinding a workpiece such as the blade of an ice skate 12. When used for sharpening ice skates the apparatus will produce a uniformly consistent high quality edge and may be adjusted to grind any one of wide variety of hollow ground curvatures in blades of various thicknesses. When the invention is used in a skate sharpening machine the apparatus 10 is generally organized about a housing 14 formed with a forwardly extending lower bed 16 having a generaly flat, smooth, upper surface 18 forming a support for a moveable skate holder 20. The skate holder is moveable over the top of the surface 18 for guiding a blade 22 of the skate 12 during the grinding and sharpening operation. The holder 20 is provided with a clamping assembly 24 which clamps the blade 22 tightly in place for grinding. At the rear of the housing 14 is an upright portion normally enclosed by a hinged cover 26 having a horizontal panel 28 and a downwardly extending front panel 30, the cover being connected to the rear of the housing by means of a hinge 32.

The rear portion of the housing and the cover substantially enclose a power driven belt grinding system comprised of a pair of pulleys 34 and 36, a relatively fixed elongated platen or rest 38 and an endless abrasive belt 40. A motor 42 is drivingly connected to one of the pulleys, such as pulley 34, with the motor 42 controlled as by means of a switch 44 located on the exterior of the housing within reach of the operator. As a safety measure a cutout switch may also be provided in the motor circuit to de-energize the motor in the event that the housing cover is opened. This can be conveniently done by means of a mercury switch or a normally open switch having an actuator button contacting the cover and kept closed as long as the cover is closed.

Figure 4:
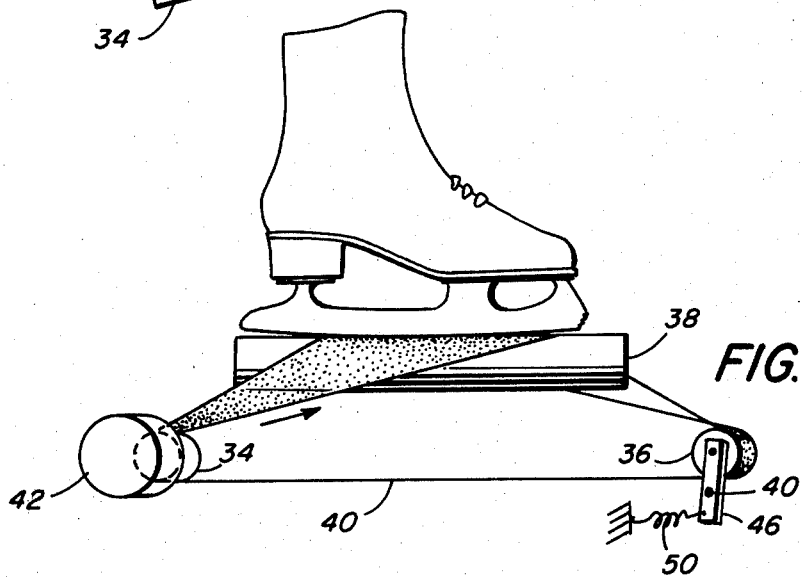
FIG. 4 is a top plan view of the FIG. 3 components shown grinding a skate blade.

In order to maintain tension on the belt 40 one of the pulleys, preferably the pulley 36, is provided with a spring loading arrangement such as shown in FIG. 4. A variety of different spring loading arrangements may be provided and, in the illustrated embodiment, the spring loading includes a support arm 46 pivotally mounted to a part of the frame (not shown) by means of a pivot pin 48. The upper end of the arm 46 as shown in FIG. 4 rotatably supports the pulley 36 while the lower end of the arm engages a coil spring 50 connected to a fixed part of the housing. The arrangement provides a spring loading in a clockwise direction about the pin 48. This not only applies tension to the belt but also permits replacement of the belt when such becomes necessary. Because of the spring loading arrangement, the pulley 36 can be retracted sufficiently to remove one belt and replace it with another. As an alternative measure, a separate idler pulley, also spring loaded, may engage the belt at some point along its path for the purpose of applying tension and to permit replacement of the belt.

Figure 3:
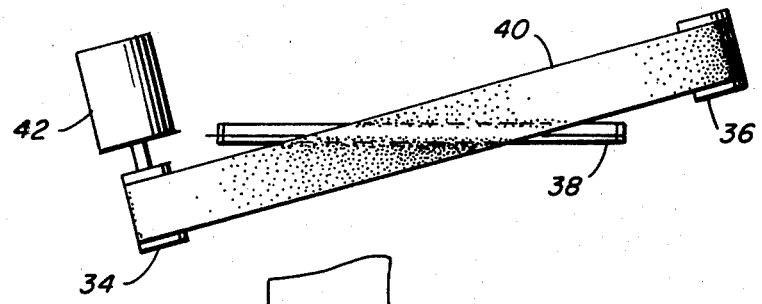
FIG. 3 is a view in front elevation showin the major components of the apparatus.

As best shown in FIGS. 3 and 4, the pulleys 34 and 36 are so positioned with respect to the rest 38 that the belt 40 passes diagonally across the working face of the rest to span a substantial portion of the length of the rest. While the angle at which the belt wraps across the working face of the platen may be varied, it is preferred, in order to achieve the most use of the belt, that the angle be relatively small as measured from the longitudinal plane of the rest. An angle of perhaps 15° has been found satisfactory since an acute angle of this size presents a diagonal section of the belt of a very substantial extent in grinding position along the rest, as best shown in FIG. 3. It will be understood that the larger the angle becomes the less amount of the belt is presented in grinding position until the angle reaches 90° at which point the working part of the belt available will be limited to the actual width of the belt.

By moving the belt diagonally across the rest 38 a number of immediate advantages arise. First of all, grinding a relatively long workpiece such as a skate blade is carried out with very little movement of the blade needed since the diagonal section of the belt present for grinding action at the rest is equal to a very substantial portion of the length of the blade, as can be seen in FIG. 4. Secondly, since the workpiece is moved lengthwise along the rest, a skate blade, for example, will be ground by a diagonal section of the belt extending fully across in a diagonal direction of the belt so that the belt is worn evenly over its entire width and length. Such would not be the case if the belt were carried longitudinally along a rest and a skate blade were brought against the belt face in a lengthwise direction. A third advantage is that since the belt is worn uniformly over its entire width and length, the belt life is greatly extended as compared to a belt that is worn only along its center portion, for example. This also produces more uniform and higher quality results in the workpiece. Also, when used as a skate sharpening machine, it has been found that the diagonal motion of the belt over the rest aids in moving the skate blade lengthwise of the rest because of the forward component of force applied to the blade. Also, the downward component of the diagonally moving belt helps keep the blade under control as the operator guides the blade against the belt.

In a working embodiment of the invention a 2" wide belt carried diagonally across the rest provided a 6" diagonal working reach across the rest.

Figure 7:
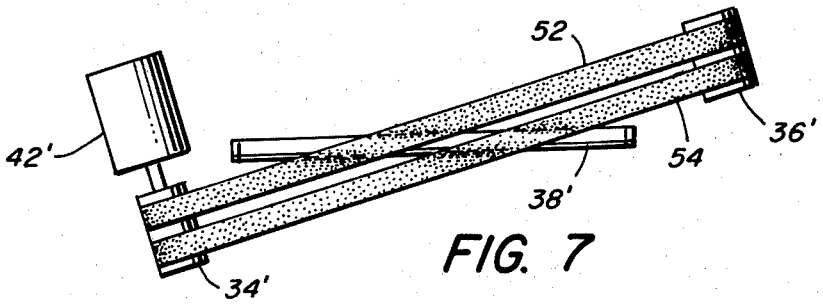

In the embodiment of FIGS. 3 and 4 a single belt of one grit size is shown. However, in some instances it might be desirable to have one belt with two different abrasive parallel bands, one a coarse grit and the other a fine grit so that, as a workpiece such as a skate blade is moved across the belt, the coarse section will first produce a coarse grinding action followed by the fine grit band which will produce a smoother, finished grinding action on the blade. This double action grinding may be done with a single double band belt or multiple belts 52 and 54 may be provided as suggested in FIG. 7. In practice, the use of the two belts, namely a coarse belt 52 and a fine belt 54, may be used as suggested in FIG. 7. In FIG. 7 the two belts are wrapped about a single set of pulleys 34' and 36' and, typically, the belts 52 and 54 are narrower than the belt 40 of the principal embodiment. When using multiple belts good results are obtained with belts each in a width of 1". As a modification of the multiple belt arrangement each of the belts may be separately mounted to their own pulley and drive system with one reach of each belt guided diagonally across a single rest in parallel relation to the other belt(s) in the system.

Different types of skates have blades which differ in thickness according to the type of skate involved. For example, the blade of a hockey skate normally is $\frac{1}{8}$" thick while the blades of figure and goalie skates are 5/32" thick. If a skate edge were mounted for grinding on the clamp device 20 the centerline of the blade would be off center with respect to the curvature of the rest edge if different blade thicknesses were passed through a machine and no compensation was made for the difference in thicknesses. By way of example, if figure skates were sharpened by the machine and hockey skates were ground afterwards without changing the platen position, the radius of curvature produced in the first blades would be along the center line of the blades while it would be off center on the second blades. Also, since different types of skates normally are hollow ground to different radii of curvature, a different rest curvature should be available when the apparatus is used for sharpening skate blades. By way of example, most ice skates normally are hollow ground to a radius of curvature in the range of $\frac{1}{4}$" to 1".

Figure 5:
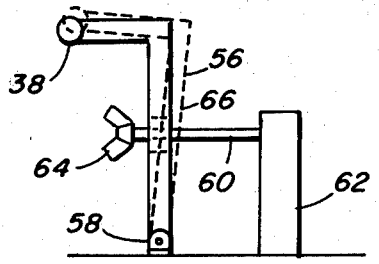
FIG. 5 is a view in side elevation showing a platen adjustment mechanism.

In FIG. 5 there is shown an adjustment mechanism which may be used for raising and lowering the center of curvature of the rest 38. In FIG. 5 the rest is carried by a frame 56 which is in the form of an inverted L, the lower end of which is pivoted to a bracket 58. The frame 56 may be pivoted back and forth about the bracket 58 by means of a lead screw 60 the right hand end of which is rotatably supported by a block 62, for example, while the left hand end is provided with winged head 64. A follower nut 66 engages the frame 56 so that rotation of the lead screw will cause the frame to move back and forth, effectively raising and lowering the working face of the rest as shown in dotted line.

Figure 6:
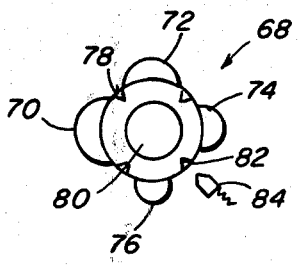
FIG. 6 is a changeable platen head made according to the invention, and, FIG. 7 is a view similar to FIG. 3 showing a modification of the invention.

In FIG. 6 there is shown a multi-position rest element having different working faces, each with its own radius of curvature. The rest of FIG. 6 is generally indicated by the reference character 68 and, in this embodiment, includes four working faces 70, 72, 74 and 76 of gradually decreasing radii. The several working faces are formed lengthwise of a sleeve 78 rotatably supported on a center shaft 80 and are adapted to be locked into any working position by rotating the sleeve to the desired position with the sleeve then being locked by suitable locking mechanism such as a spring-loaded detent and indent arrangement 82 and 84.

Figure 2:
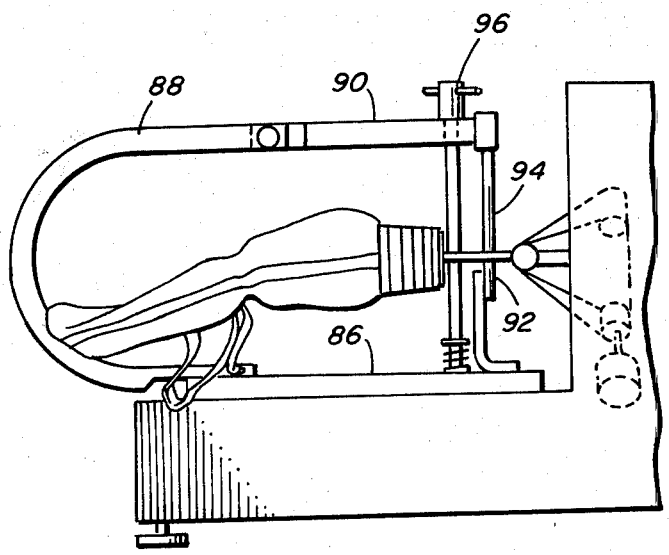
FIG. 2 is a view in end elevation thereof.

The clamp mechanism 20 involves a flat base portion 86 having an upright U-shaped frame 88 fixed thereto and provided at its upper end with a hinged member 90. The base 86 carries lower clamp portion 92 while an upper clamp portion 94 is carried by the member 90. The portions 92 and 94 are aligned with one another when clamped against opposite sides of the blade, as best shown in FIG. 2. A screw locking device 96 is provided to lock the parts together during the grinding operation. Unlocking the device 96 allows the member 90 to be swung up and away of the lower clamp parts in order to remove or replace the skate.

While the invention has been described with particular reference to the illustrated embodiments, numerous modifications thereto will appear to those skilled in the art.

For example, some skates, especially hockey skates, in addition to being hollow ground are also made with a slight longitudinal concave curve. Typically the longitudinal curve is on a longitudinal radius of about 9'. For such skates a platen with a corresponding 9' longitudinal convex radius may be provided to maintain the same longitudinal curvature when sharpening the skates. When a longitudinally curved platen is provided a tilting type height adjustment cannot be used but rather a mechanism such as a vertical screw adjust, rack and pinion or the like would be required to raise and lower the platen in a vertical plane.

Having thus described the invention, what I claim and desire to obtain by Letters Patent of the United States is:

1. Apparatus for grinding a workpiece such as a skate blade or the like, comprising (a) an elongated and relatively straight platen;

(b) at least a pair of pulleys spaced from one another;

(c) power means drivingly connected to at least one of said pulleys;

(d) an endless abrasive belt looped about said pulleys in driving engagement therewith and against said platen;

(e) said pulleys disposed to guide said belt diagonally with respect to the length of said platen whereby a diagonal section of said belt will be presented at said platen to said workpiece;

(f) said platen being a shaft which rotatably supports a sleeve having a plurality of differently contoured working faces moveable into and out of working engagement with said belt; and (g) a housing having a generally flat, straight bed extending parallel to said platen and a workpiece holder adapted to be moved along said bed to carry said workpiece lengthwise against that diagonal portion of said belt moving over said platen.

2. Apparatus according to claim 1 wherein the axes of said pulleys are parallel to one another and oriented at a tilt angle with respect to the length of said platen.

3. Apparatus according to claim 1 including belt tensioning means operatively associated with said belt.

4. Apparatus according to claim 1 including adjustment means engaging said platen for selectively changing the distance between said bed and said platen.

5. Apparatus according to claim 1 wherein said belt is formed with a plurality of parallel bands each of a different abrasive character.

6. Apparatus according to claim 1 including a second abrasive belt looped about said pulleys in parallel relation to the first belt and having an abrasive character different from said first belt.

* * * * *